US005190483A

United States Patent [19]

Viselli

[11] Patent Number: 5,190,483

[45] Date of Patent: Mar. 2, 1993

[54] CONTACT RETENTION

[75] Inventor: Michael A. Viselli, Middletown, Pa.

[73] Assignee: AMP Incorporated, Harrisburg, Pa.

[21] Appl. No.: 835,789

[22] Filed: Feb. 14, 1992

[51] Int. Cl.[5] ..... H01R 13/41; H01R 13/436

[52] U.S. Cl. ..... 439/751; 439/752

[58] Field of Search ..... 439/751, 752, 686, 695, 439/701, 901, 904, 905, 567, 571, 607

[56] References Cited

U.S. PATENT DOCUMENTS

| | | | |
|---|---|---|---|
| D. 303,109 | 8/1989 | Matsuzaki et al. | D13/24 |
| 3,479,637 | 11/1969 | Gilissen | 439/752 |
| 3,820,055 | 6/1974 | Huffnagle et al. | 339/17 F |
| 4,127,317 | 11/1978 | Tyree | 439/752 |
| 4,241,970 | 12/1980 | Rider, Jr. et al. | 339/99 R |
| 4,390,231 | 6/1983 | Plyler et al. | 339/217 S |
| 4,439,001 | 3/1984 | Curley et al. | 339/176 MP |
| 4,464,003 | 8/1984 | Goodman et al. | 339/99 |
| 4,531,803 | 7/1985 | Hughes | 339/97 R |
| 4,557,543 | 12/1985 | McCleerey et al. | 339/97 |
| 4,717,354 | 1/1988 | McCleerey | 439/444 |
| 4,735,585 | 4/1988 | Palmer, III et al. | 439/752 |
| 4,749,373 | 6/1988 | Brekosky et al. | 439/595 |
| 4,775,336 | 10/1988 | Paulo | 439/830 |
| 4,808,125 | 2/1989 | Waters et al. | 439/607 |
| 4,990,104 | 2/1991 | Schieferly | 439/578 |
| 4,993,975 | 2/1991 | Asick et al. | 439/751 |
| 5,026,304 | 6/1991 | Furrow | 439/752 |
| 5,046,153 | 9/1991 | Konopa et al. | 439/751 |

FOREIGN PATENT DOCUMENTS

| | | | |
|---|---|---|---|
| 424634 | 7/1948 | Italy | 439/751 |

*Primary Examiner*—Gary F. Paumen

*Attorney, Agent, or Firm*—David L. Smith

[57] ABSTRACT

An electrical connector (20) has a dielectric housing (22) with at least one channel (46) therein. A contact (26) having a mating end (74), a mounting end (84) and a body section (94) extending therebetween is disposed in the channel. The body section (94) between the mating end and the mounting end defines an axis. The body section also defines opposed first and second major surfaces (96,98). A first protrusion (104) extends from one of the major surfaces proximate the mating end (74) of the contact and a second protrusion (106 or 108) extends from one of the major surfaces at a location spaced from the mating end (74) farther than the first protrusion (104). In this manner the contact (26) is caused to resiliently bend forming an "S" bend which provides a slight interference fit at spaced locations along the length of the contact to retain the contact in the channel.

21 Claims, 13 Drawing Sheets

CONTACT RETENTION

BACKGROUND OF THE INVENTION

This invention relates to securing contacts in a connector housing and, in particular, to securing contacts in a housing in a manner to provide uniform center lines spacing.

Contacts have been retained in connector housings by an interference fit such as in U.S. Pat. Nos. 4,808,125; 4,717,354; 4,993,975; 3,820,055; 4,755,336; 4,531,803; 4,439,001; and 4,241,970; and by plastic or metal tines such as in U.S. Pat. Nos. 4,749,373; 4,990,104; 4,557,543; and 4,390,231.

SUMMARY OF THE INVENTION

In accordance with the present invention, an electrical connector has a dielectric housing with at least one channel therein. A contact having a mating end, a mounting end and a body section extending therebetween is disposed in the channel. The body section between the mating end and the mounting end defines an axis. The body section also defines opposed first and second major surfaces. A first protrusion extends from a first major surface proximate the mating end of the contact and a second protrusion extends from a second major surface at a location spaced from the mating end farther than the first protrusion. In this manner the contact is caused to deflect forming a "S" bend which provides a slight interference fit as spaced locations along the length of the contact to retain the contact in the channel.

DESCRIPTION OF THE PREFERRED EMBODIMENT

Figure 1:
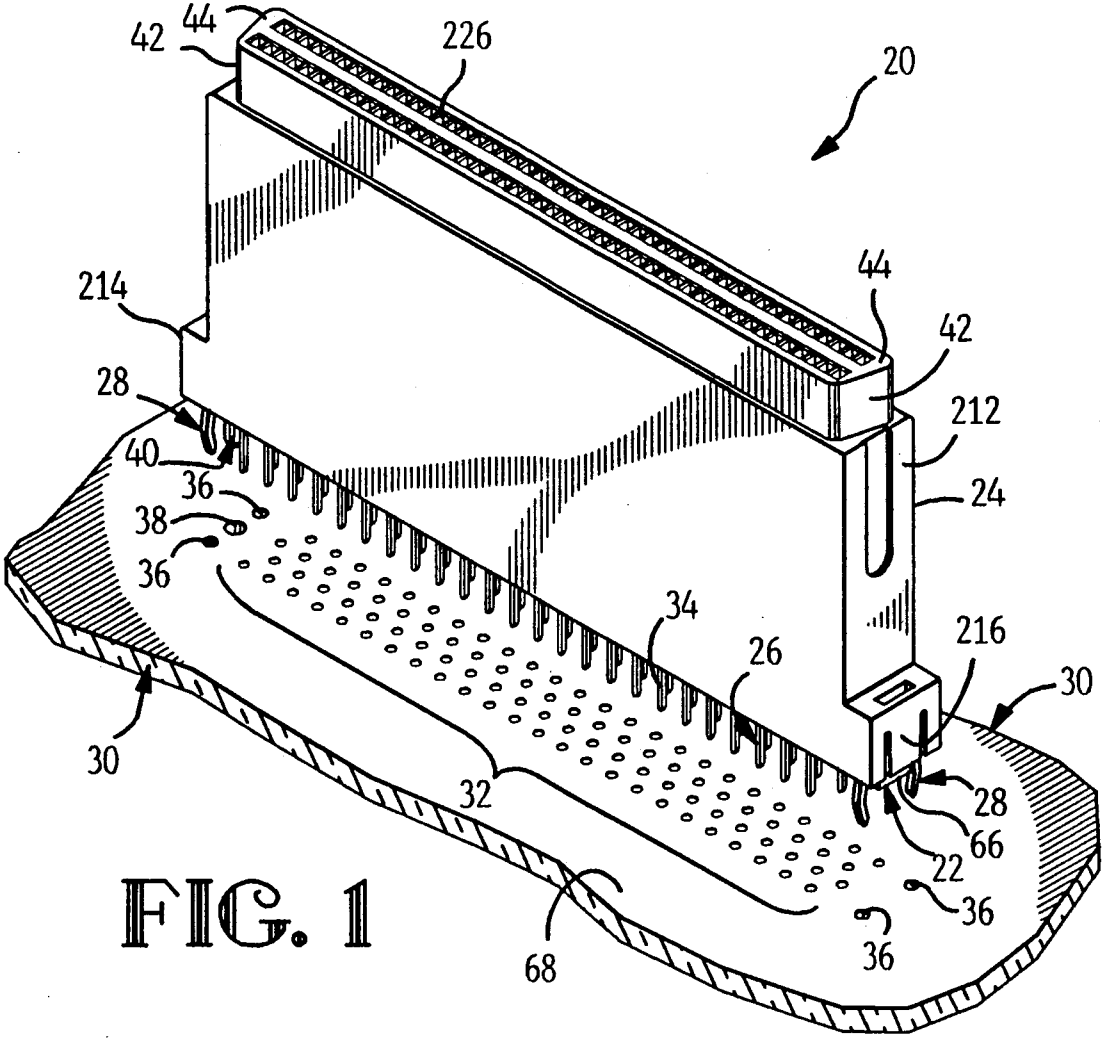
FIG. 1 is an asymmetric view of a connector incorporating the contact retention of the present invention.

As shown in the perspective view of FIG. 1, connector 20 is a vertical board mount connector providing contact retention in accordance with the present invention. Connector 20 includes inner housing 22, outer housing 24 and contacts 26. Connector 20 may also include boardlocks 28. Connector 20 is shown above a circuit board 30 having an array of through holes 32 to receive the solder tails 34 of contacts 26, holes 36 to receive legs of boardlocks 28, and a hole 38 to receive a polarization protrusion 40. Connector 20 has a trapezoidal shroud 42 proximate mating face 44. Housings 22 and 24 are typically molded of any suitable thermoplastic.

Figure 2:
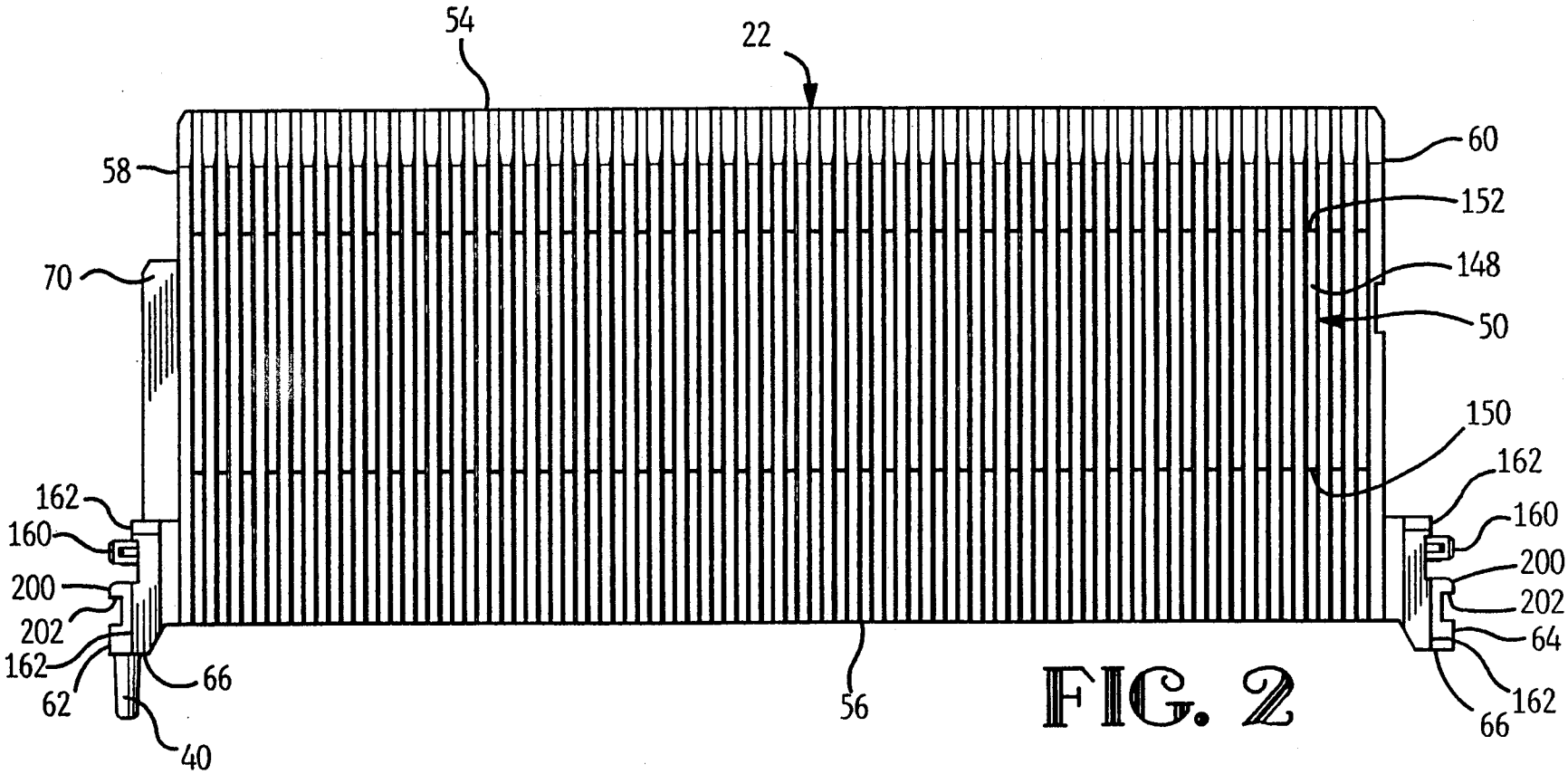
FIG. 2 is a side view of the inner housing.
Figure 3B:
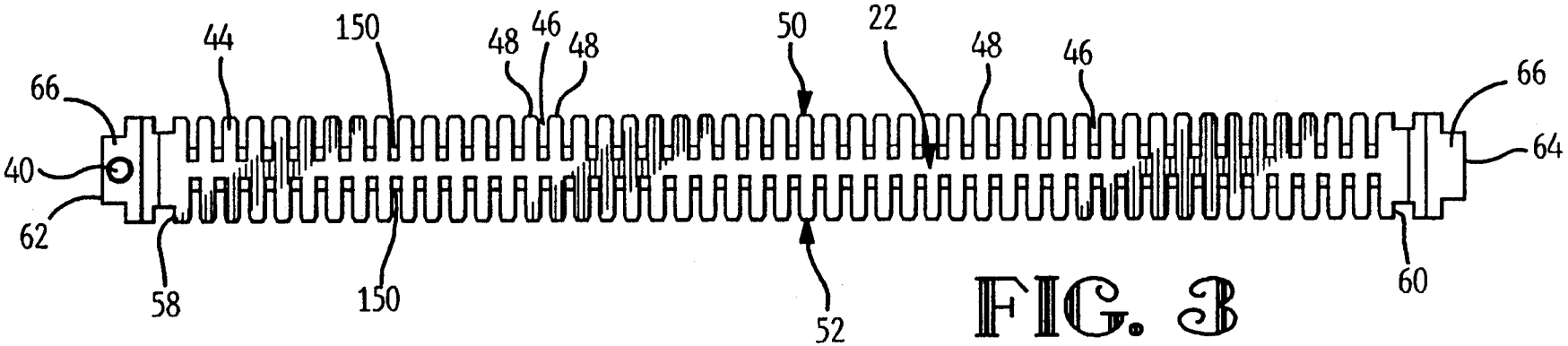
FIG. 3 is a bottom view of the inner housing.

Inner housing 22, as best seen in FIGS. 2 and 3, has a plurality of spaced contact receiving channels 46 separated by ribs 48 formed in both first and second major surfaces 50 and 52. Channels 46 extend from forward face 54 to rear face 56 and extend across at least a portion of the width of inner housing 22 from first end wall 58 to second end wall 60. Extending from end walls 58 and 60 are standoffs 62 and 64, the bottom surface 66 of which engages the upper surface 68 (see FIG. 1) of circuit board 30 on which connector 20 is mounted. Extending from surface 66 of standoff 62 is a polarization protrusion 40 receivable in hole 38 simultaneously with solder tails 34 being received in holes 32 and legs of boardlocks 28 being received in holes 36. Polarization protrusion 40 assures that connector 20 is mounted on circuit board 30 in the proper orientation. Also extending outwardly from first end wall 58, above standoff 62, is an inner housing to outer housing polarization rib 70.

Figure 4:
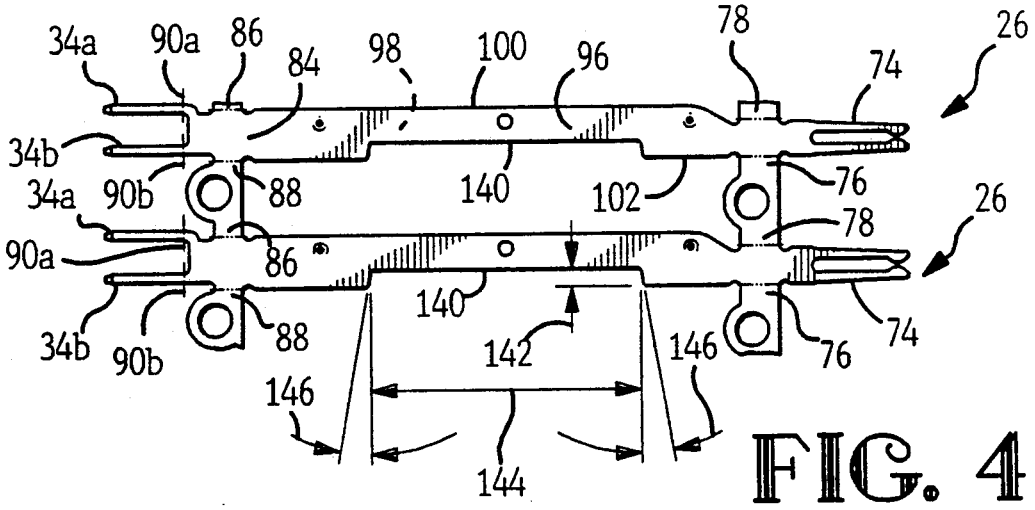
FIG. 4 is a side view of a pair of contacts as stamped interconnected by a carrier strip near each end.

Contacts 26 are stamped and formed on strip and as stamped are shown in FIG. 4. Proximate the mating and 74 a first carrier strip 76 interconnects adjacent contacts 26. Prior to being stitched into a channel 46 of inner housing 22 contacts 26 are severed from first carrier strip 76, such as along broken line 78, in any known manner.

Proximate the solder tail end 84 of contact 26, a second carrier strip 86 interconnects adjacent contacts 26. Prior to being stitched into a channel 46 of inner housing 22, contacts 26 are also severed from second carrier strip 86 such as along broken line 88.

Each contact 26 is originally stamped with two spaced solder tails **34*a* and 34*b*. One of the two solder tails is severed such as along broken line 90*a* or 90*b* with the result that each contact retains only one solder tail. One solder tail in each contact is severed such that in the assembled connector the solder tail on adjacent contacts alternates in position, resulting in a staggered footprint evident from the array of holes 32 in FIG. 1**.

Figure 5:
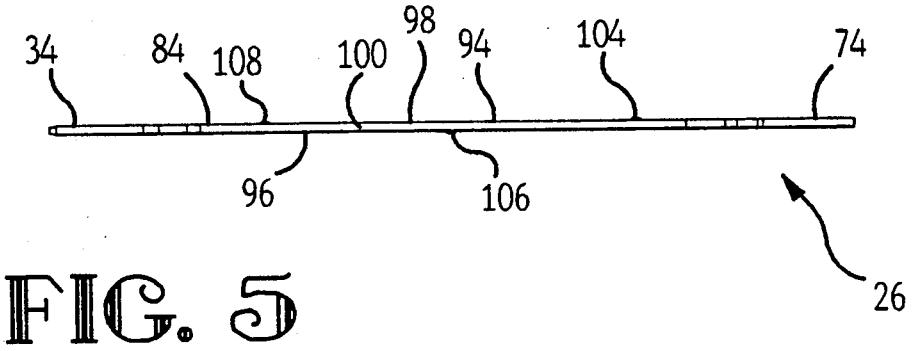
FIG. 5 is a top view of a contact.

Between mating end 74 and solder tail end 84, each contact 26 has an elongate body section 94 as best seen in FIGS. 4 and 5, body section 94 is defined by opposed first and second major surfaces 96 and 98, that are typically rolled surfaces, and opposed first and second minor surfaces 100 and 102, that are typically sheared surfaces. At spaced locations along body section 94 there is at least one retention protrusion extending beyond the plane of each of surfaces 96 and 98. A first protrusion 104 extends from surface 98 proximate mating end 74. A second protrusion 106 extends from surface 96 at a location spaced toward solder tail end 84 from protrusion 104. In a preferred embodiment there are three protrusions spaced along body section 94 between mating end 74 and solder tail end 84, two extending from a first major surface one each proximate the mating and solder tail ends 74 and 84, with a third protrusion positioned therebetween and extending from a second major surface. The preferred embodiment shown in FIGS. 4 and 5 shows third protrusion 108 extending from second major surface 98 proximate solder tail end 84. In this manner, there are three spaced protrusions along the body portion of the contact, two extending from one of the major surfaces and a third protrusion intermediate the other two protrusions extending from the other major surface.

Protrusions 104, 106 and 108 in the preferred embodiment are convex and formed in contact 26 during the stamping operation by a force applied to the opposite major surface from which the protrusion extends. In the preferred embodiment, protrusions 104, 106 and 108 extend beyond a major surface a distance such that the total distance from the other major surface to the apex of the protrusion is substantially the width of a channel 46.

Figure 6:
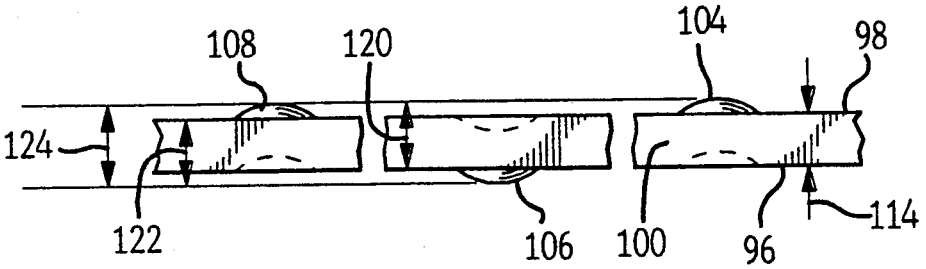
FIG. 6 is an enlarged top view of a portion of the contact in FIG. 5.
Figure 7:
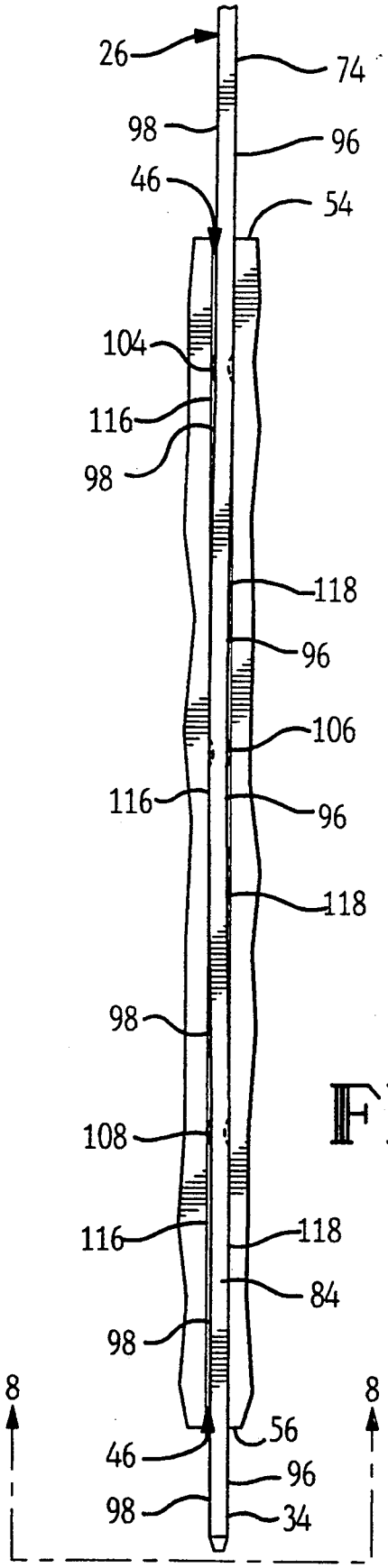
FIG. 7 is a top view of a contact in a channel in the inner housing.
Figure 8:
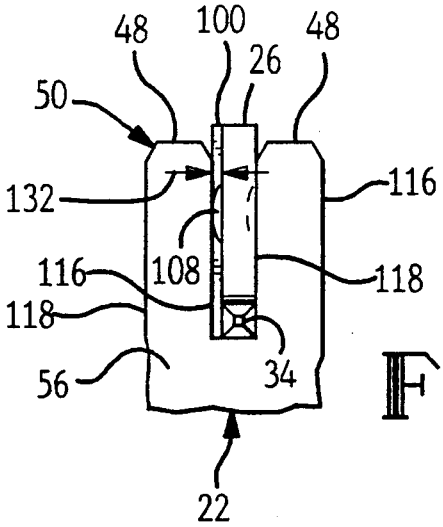
FIG. 8 is a bottom view of a channel in the inner housing with a contact received therein.

As shown in FIGS. 6, 7 and 8 the thickness 114 of contact 26, between opposed first and second major surfaces 96 and 98, is less than the spacing between facing sidewalls 116 and 118 that define the width of a channel 46. The distance 120 between the plane of first major surface 96 and the apex of either protrusion 104 or 108, as well as the distance 122 from the plane of second major surface 98 to the apex of protrusion 106, in the preferred embodiment, is substantially the same distance as the width of a channel 46. That is, distances 120 and 122 in the preferred embodiment are substantially equal to the distance between facing sidewalls 116 and 118 of a channel 46.

Figure 9:
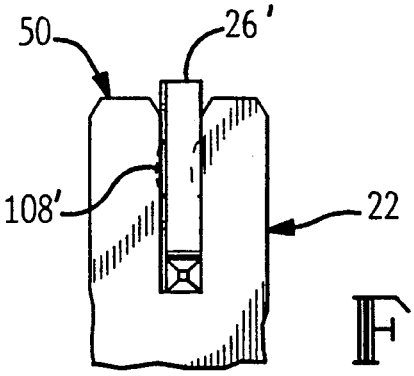
FIG. 9 is a view similar to FIG. 8 showing an alternate embodiment wherein the protrusion engages a channel wall in an interference fit.

It should be noted here, however, that for the contact retention system to function, the distance 124 from the apex of either protrusion 104 or 108 to the apex of protrusion 106 need only be greater than the width of a channel 46 as defined by the spacing between facing sidewalls 116 and 118. This will prevent the first and second major surfaces 96 and 98 from being parallel to sidewalls 116 and 118 such that the plane of one of the major surfaces will necessarily intersect the plane of one of sidewalls 116 or 118. In addition, one or more of the protrusions 104, 106 and 108 could provide an interference fit with a sidewall of channel 46 as shown in FIG. 9, although this is not necessary.

As best seen in FIGS. 7 and 8, protrusions 104, 106 and 108 cause the body section of contact 26 to bend as the apexes of the protrusions 104 and 108 engage sidewall 116 and the apex of protrusion 106 engages sidewall 118. Due to protrusion 106 positioning second major surface 98 toward sidewall 116 and protrusion 104 pushing first major surface 96 toward sidewall 118, as contact 26 extends toward forward face 54 from protrusion 104, first major surface 96 engages sidewall 118. Forward of where first major surface 96 engages sidewall 118, surface 96 extends along the plane of sidewall 118. The mating portion of contact 26 extends beyond surface 54 with surface 96 coplanar with sidewall 118.

But for protrusion 104, contact 26 would extend forwardly from the region where second major surface 98 engages sidewall 116 along sidewall 116 with the mating end 74 extending beyond forward face 54 with surface 98 coplanar with sidewall 116.

Similarly, due to protrusion 106 positioning second major surface 98 toward sidewall 116 and protrusion 108 pushing first major surface 96 toward sidewall 118, as contact 26 extends toward rear face 56 from protrusion 108, first major surface 96 engages sidewall 118. Rearward of where first major surface 96 engages sidewall 118, surface 96 extends along the plane of sidewall 118. The solder tail 34 extends beyond surface 56 with surface 96 coplanar with sidewall 118.

But for protrusion 108, contact 26 would extend rearwardly from the region where second major surface 98 engages sidewall 116 along sidewall 116 with solder tail 34 extending beyond surface 56 with surface 98 coplanar with sidewall 116.

With three protrusions, the contact bends slightly upon insertion into a channel to take on an "S" shape which provides a very slight interference fit between portions of the major surfaces of the contacts in the sidewalls of the channel in which the contact is received to secure the contact in the channel. The slight interference fit is not necessarily at the location of the protrusions.

The general pattern can be observed that the protrusions closest to each end of the contact cause the contact to engage the channel sidewall opposite the protrusion. Thus if the last protrusion within channel 46 proximate each end of the contact extend beyond the same major surface, those portions of the contact that extend beyond surfaces 54 and 56 will be coplanar along the same side of channel 46, that side being opposite the last protrusion. When the last protrusions within channel 46 proximate each end of the contact extend beyond opposite major surfaces of contact 26, those portions of the contact that extend beyond surfaces 54 and 56 will do so along opposite sides of channel 46. Thus if protrusions alternate along the length of the contact in extending from opposite major surfaces of the contact, an even number of protrusions will cause the mating end of the contact to engage one side of channel 46 proximate forward face 54 and the solder tail end 84 of the contact to engage the other side of channel wall 46 proximate rear face 56, whereas an odd number of protrusions along the length of the contact will cause the contact to engage the same side of channel 46 proximate both forward face 54 and rear face 56. In the preferred embodiment, the three protrusion alternate as described above, and as can be seen in FIG. 7.

FIG. 9 is an alternate embodiment showing a protrusion 108' on a contact 26' that provides an interference fit with a sidewall of channel 46.

In the preferred embodiment, contacts 26 placed in channels 46 on both first and second major surfaces 50 and 52 are identical. After the contacts are stitched into channels in one of the two major surfaces of the inner housing, the inner housing is turned over and the contacts are stitched into channels in the other major surface of the inner housing. The center line spacing of the channels in each major surface 50 and 52 are spaced at the desired contact spacing, since the contact thickness is less than the channel width, with each contact pressed to one side of the channel, uniform contact spacing is maintained.

Figure 10:
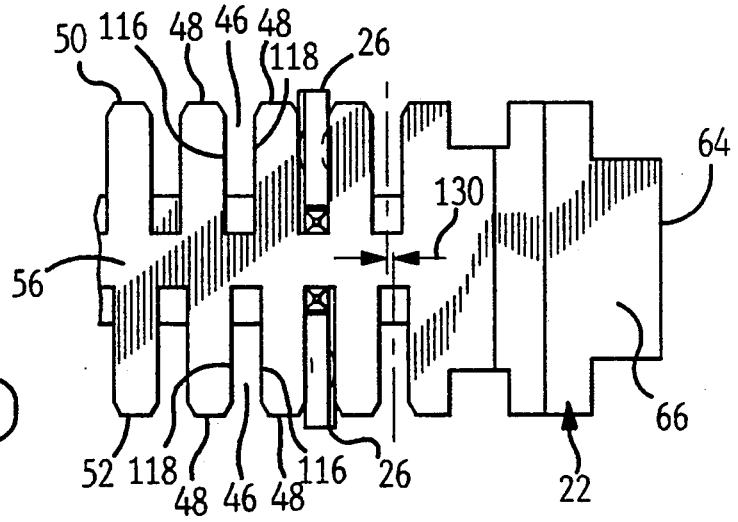
FIG. 10 is an enlarged bottom view of a portion of the inner housing.

As seen in FIG. 10 with contacts viewed from surface 56, contacts 26 received in a channel 46 of first major surface 50 are pushed to the right while contacts received in a channel 46 of second major surface 52 are pushed to the left. The same analysis can be made with the same result of the mating ends 74 of contacts 26. To maintain the solder tails and mating ends in alignment transverse to the end wall to end wall width of inner housing 22, the center line of each in the row of channels in first major surface 50 is laterally offset at 130 from the center line of each channel in the row of channels in second major surface 52. The amount of offset 130 will depend of several factors in the design of the connector, but is substantially half of the unused width 132 (see FIG. 8) of a channel 46.

For a connector such as the preferred embodiment wherein the channels are 0.0200 inch (0.51 mm) wide on a 0.0500 inch (1.27 mm) center line spacing with contacts that are 0.0160 inch (0.41 mm) thick having three alternating protrusions (as described above) extending the effective width to a total of 0.0200 inch (0.51 mm), the amount of offset is 0.0020 inch (0.05 mm).

Figure 11:
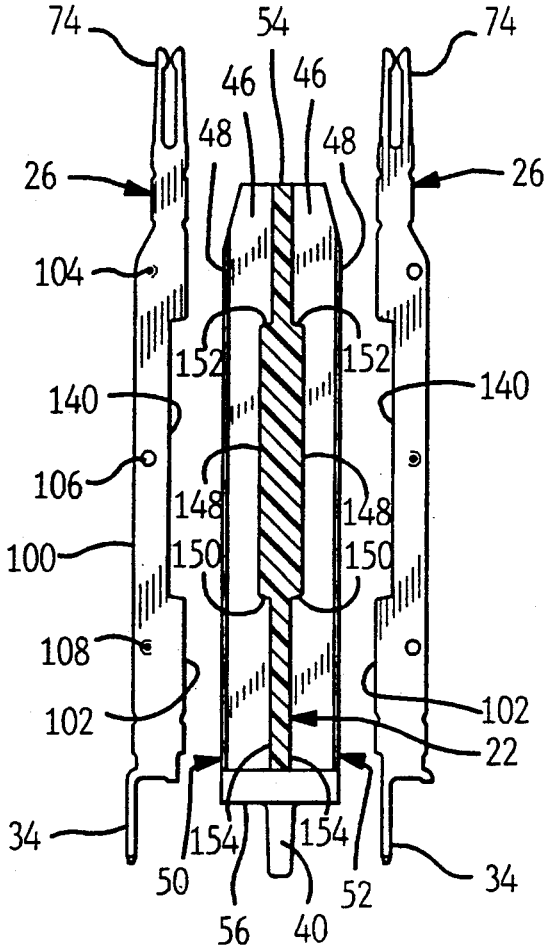
FIG. 11 is a sectional view through a channel in the inner housing with two contacts spaced therefrom.
Figure 14:
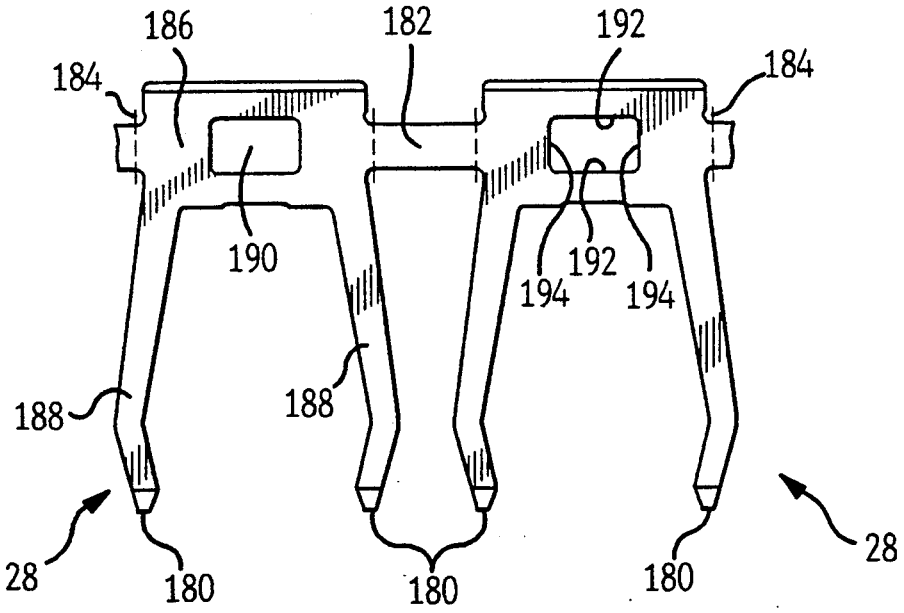
FIG. 14 is a view showing two boardlocks as stamped, on a carrier strip.

A cross section through a pair of substantially transverse channels 46 in inner housing 22 is shown in FIG. 11 with a contact 26 spaced outwardly from each channel 46. A notch 140 is made in second minor surface 102 of contact 26. Notch 140, as shown in FIG. 14, is of a predetermined depth 142 and length 144. Each end of the notch is formed with an angle 146 of about 10° to assist in axially positioning contacts 26 in channel 46 as the contact is stitched into the channel. Each channel has a complementary rib 148 having a rearward end wall 150 and a forward end wall 152 which extend upwardly from the bottom 154 of a channel less than the depth 142 of a notch 140. End walls 150 and 152 are angled to complement the angle of notch 140.

In a preferred embodiment, when contact 26 is received in a channel, minor surface 100 is positioned outwardly from inner housing 22, spaced from a respective first and second major surface 50, 52 as shown in FIGS. 8-10.

Figure 12:
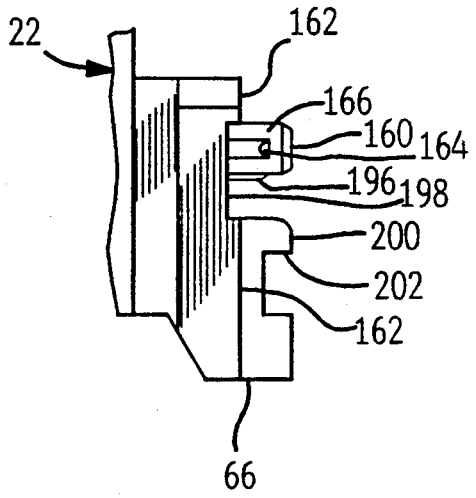
FIG. 12 is a partial view of a standoff on an enlarged scale.
Figure 13:
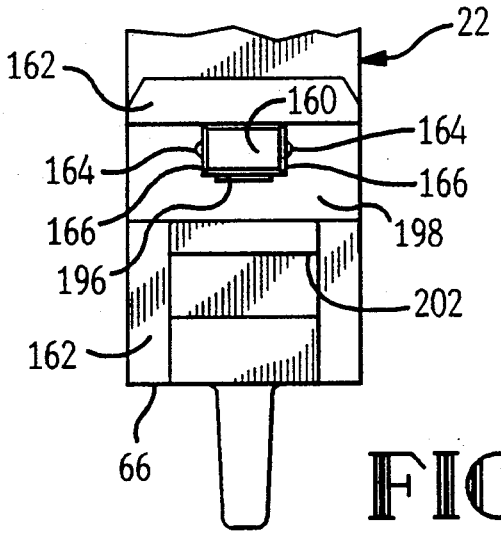
FIG. 13 is a partial end view of a standoff on an enlarge scale.

Each standoff 62, 64 has a boardlock retaining post 160 extending outwardly from a basewall 162 as shown in FIGS. 2, 12 and 13. The boardlock retaining posts are identical; therefore only one will be described. Post 160 stands outwardly from basewall 162. Post 160 has interference ribs 164 on sidewalls 166.

Figure 15:
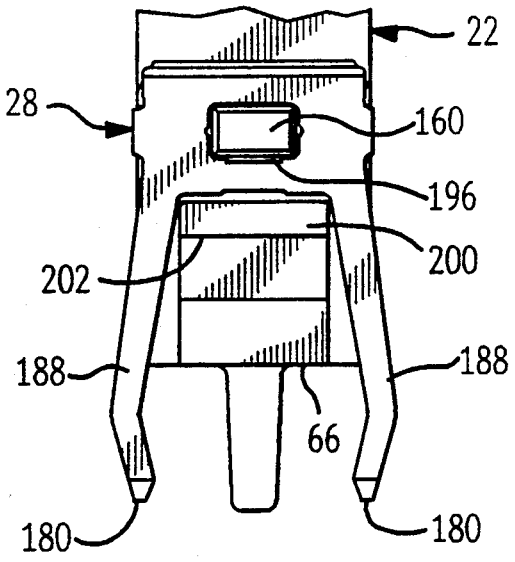
FIG. 15 is an end view of the standoff showing a boardlock temporarily secured on the boardlock retaining posts.

Boardlocks 28 shown in FIG. 14 may be stamped on a carrier strip 182 and severed along broken lines 184. Boardlock 28 has a body section 186 with legs 188 depending therefrom extending to distal ends 180. Body section 186 has a retaining aperture 190 defining walls 192 and 194. Aperture 190 is sized such that walls 192 and 194 are receivable tightly over boardlock retaining posts 160 with walls 194 received in an interference fit with ribs 164. As boardlock 28 is received over boardlock retaining post 160, wedge 196 beneath post 160 assures that a wall 192 is pulled down against the upper surface of post 164. Should ribs 160 skive as boardlock 128 is pressed over boardlock retaining post 160, the shavings do not prevent boardlock 28 from seating against basewall 162 as the skived portion can be received between the boardlock and recessed surface 198. In this manner, boardlock 28 is temporarily secured to inner housing 22 as shown in FIG. 15. Legs 188 diverge to an apex below bottom surface 66 whereupon they taper inwardly toward each other. Distal ends 180 of legs 188 are receivable in holes 36 in circuit board 30 to temporarily secure connector 20 to board 30 until soldered. Holes 36 are spaced apart substantially the same distance as distal ends 180 of the legs 188 of a boardlock 28. Upon insertion of distal ends 180 into holes 36, the reaction between holes 36 in the outer edges of the legs 188 cause the legs to flex toward each other until the lower surface of circuit board 30 passes over the apex on the legs, which begin to resile outwardly to secure connector 20 temporarily on board 30.

Beneath body section 186 and positioned between legs 188 extending outwardly from respective standoff 62 and 64 is a latch protrusion 200 having a latch shoulder 202 facing toward bottom surface 66. Latch shoulder 202 provides structure to secure the inner and outer housings together.

Figure 16:
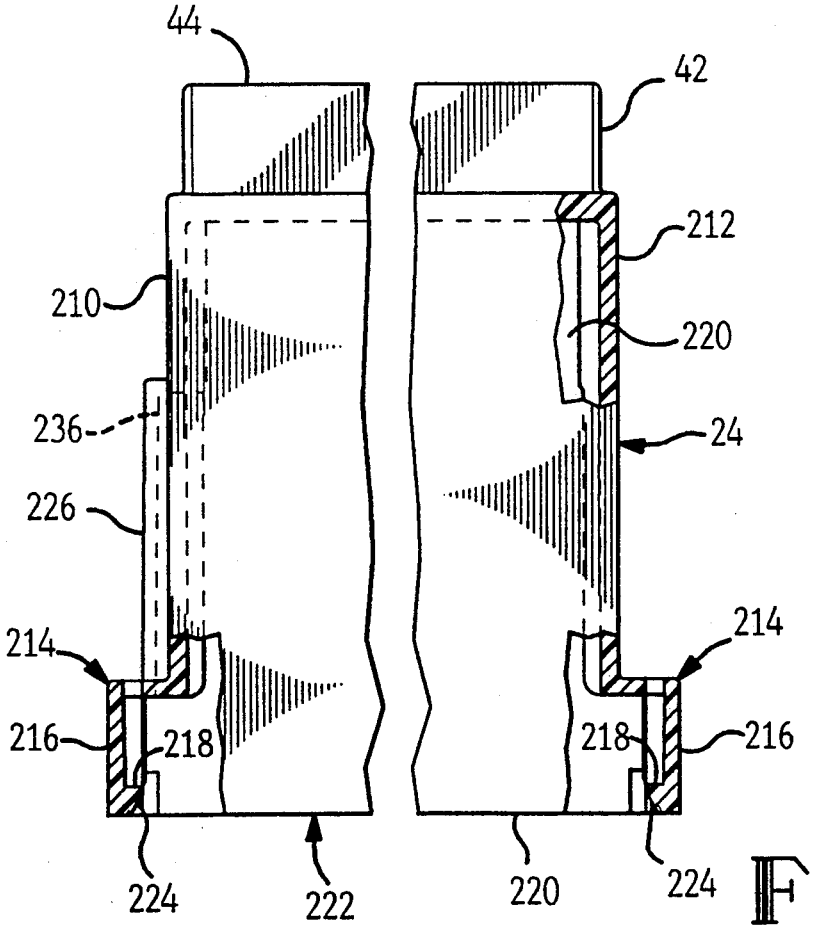
FIG. 16 is a side view, partially in section of the outer housing.

A side view of the outer housing 24, partly in section, is shown in FIG. 16. Each end wall 210, 212 has a widened rear section 214, the central portion of which forms a latch member 216 as best seen in FIGS. 1, 16 17, 18 and 19. Latch member 216 has a latch shoulder 218 facing mating face 44.

Figure 17:
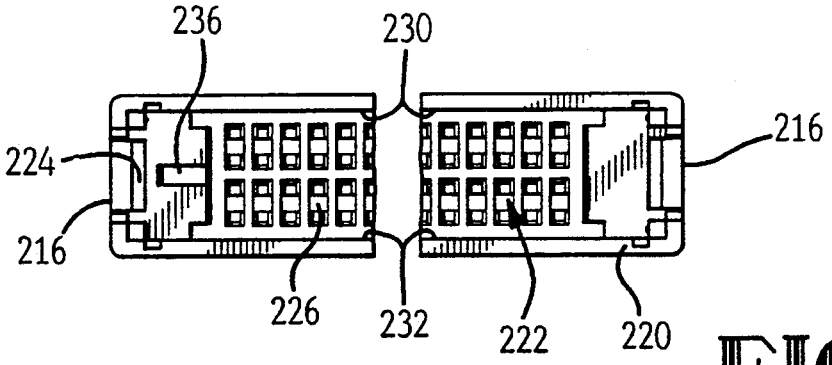
FIG. 17 is a bottom view of the outer housing.
Figure 18:
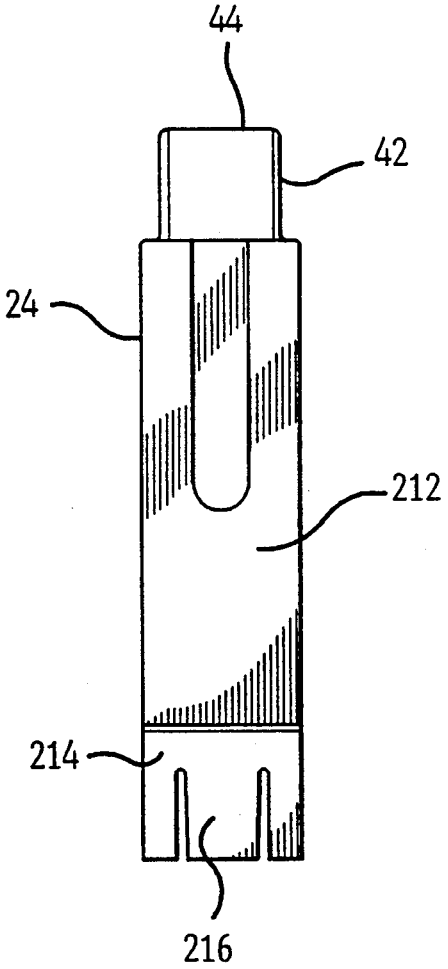
FIG. 18 is an end view of the outer housing.
Figure 19:
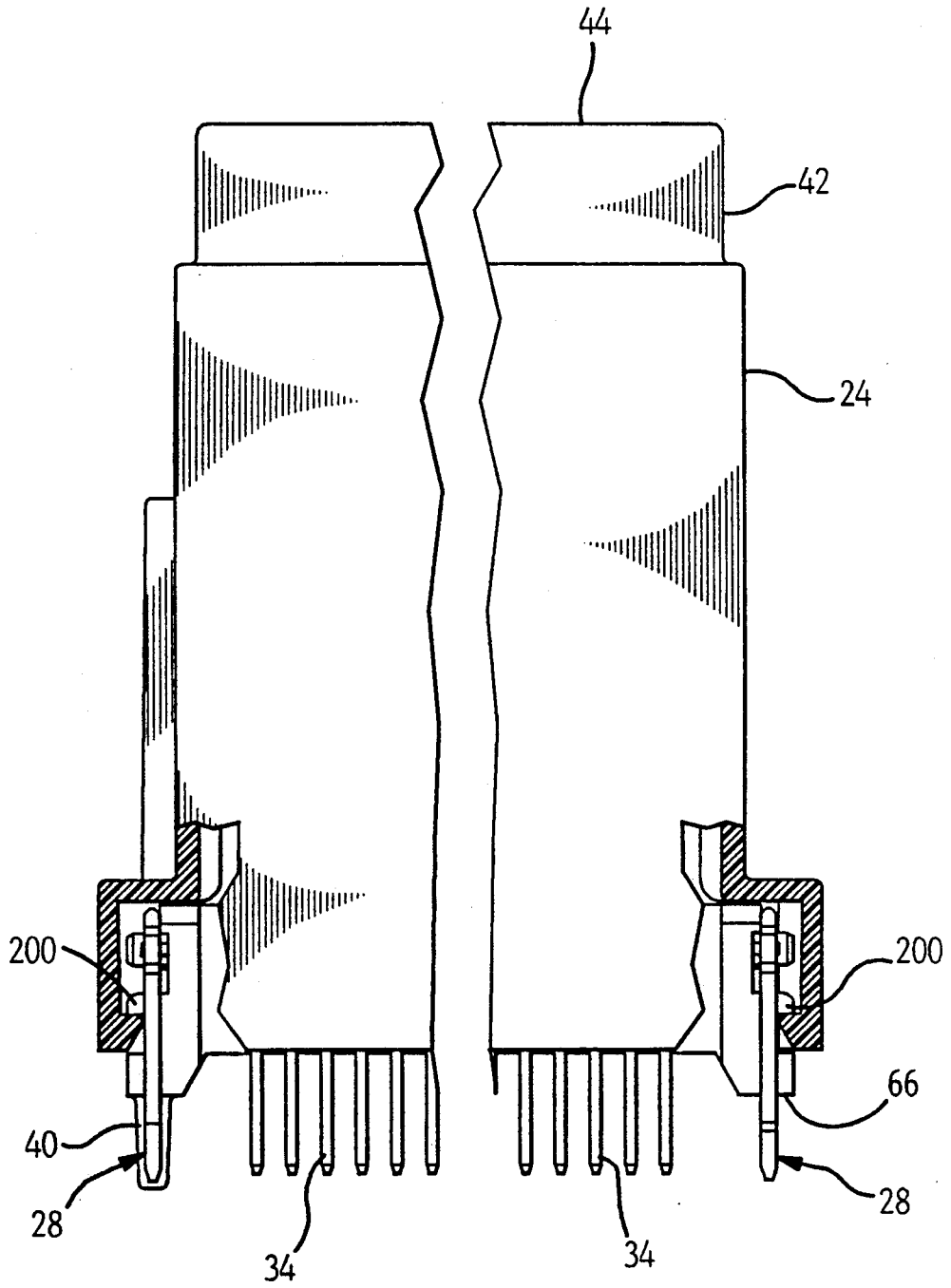
FIG. 19 is a side view, partially in section, showing how the inner and outer housings are secured ether.

A view from rear surface 220, as shown in FIG. 17, reveals the large inner housing receiving cavity 222. Channel 236 within shroud 225 is sized to receive polarization rib 70.

With contacts 26 secured in the channels of inner housing 22 and boardlocks 28 temporarily secured to the inner housing on posts 160, inner housing 22 is aligned with cavity 222. With polarization rib 70 aligned to be received in channel 236, inner housing 22 will pass into the cavity and outer housing 24. Otherwise, inner housing 22 will not pass into the cavity in outer housing 24. Outer housing 24 is passed over inner housing 22 until the ramped leading edge 224 of latch members 216 ride over latch protrusion 200 and latch member 216 resiles inwardly such that latch shoulder 218 engages latch shoulder 202 to secure the two housings together with the mating end proximate the mating face to receive pins of a mating connector through openings 226 in mating face 44 and solder tails 34 extending rearwardly beyond surface 220.

Figure 20:
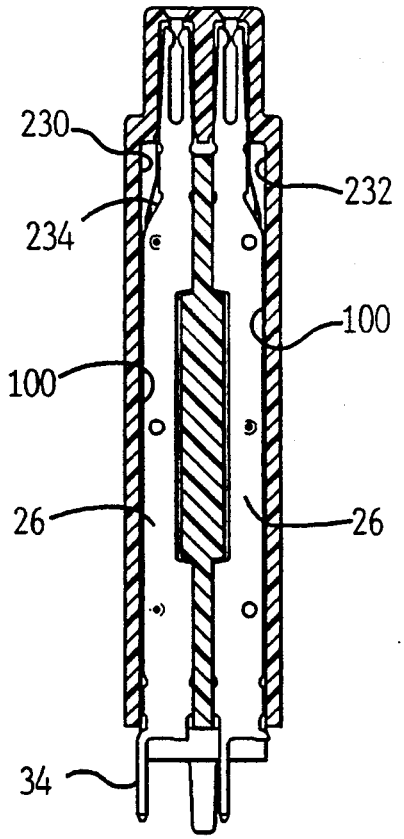
FIG. 20 is a cross section through the connector.

As shown in the cross sectional view of FIG. 20, the inner sidewalls 230, 232 of outer housing 24 may engage first minor surfaces 100 of contacts 26 to further secure contacts 26 in connector 20. Contacts 26 may be tapered at 234 to facilitate insertion of the inner housing having contacts secured therein into cavity 222.

Figure 21:
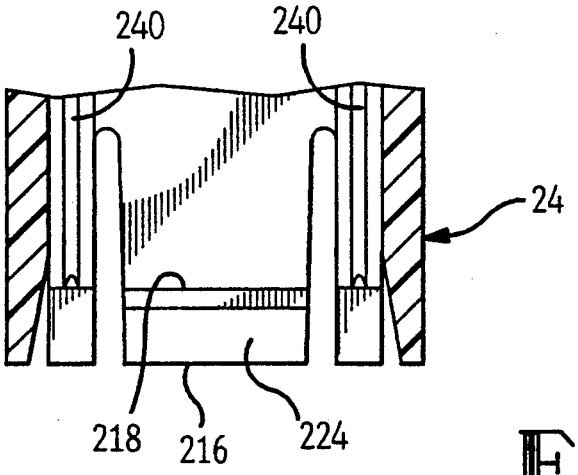
FIG. 21 is an inside end view, partly in section, of the outer housing.

As shown in FIG. 21, ribs 240 on the inner surface of widened rear section 214 engage the body section boardlock 28 to press boardlock 28 against surface of basewall 162, thereby securing boardlock 28 between the inner and outer housings.

Figure 22:
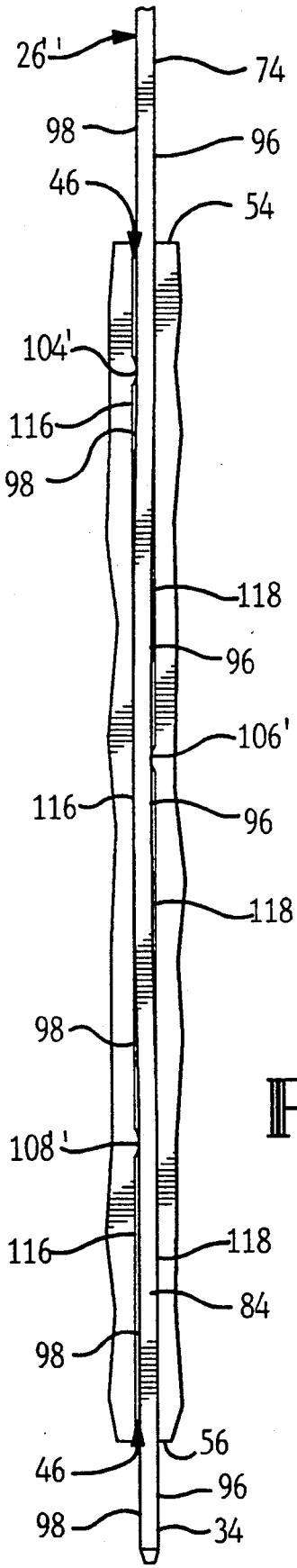
FIG. 22 is a side view of a contact in a channel of an alternate embodiment.

While the invention has been described as having protrusions on the contacts that cause the body portion of the contacts to bend along its length, ribs on the sidewalls of channel 46, such as shown in the alternate embodiment shown in FIG. 22 could function to provide the same "S" shape and the same result. As shown, ribs 104', 106' and 108'' on the sidewalls provide the same result as protrusions 104, 106 and 108. Other housing structure or contact structure could achieve the same result.

While the invention has been described with respect to a through hole mount connector, the invention is also applicable to surface mount connectors.

I claim:

1. An electrical connector, comprising:

a dielectric housing having a plurality of uniformly spaced channels in opposed major surfaces thereof, each of said channels defined by opposed first and second sidewalls;

a contact received in each channel, each contact having a mating end, a mounting end and a body section extending therebetween;

said body section defining an axis between said mating end and said mounting end, said body section defining opposed first and second major surfaces;

a first protrusion extending from the first major surface proximate said mating end to engage said first sidewall, and a second protrusion extending from one of said major surfaces to engage one of said sidewalls at a location axially spaced from said mating end farther than said first protrusion, whereby each contact is resiliently bent by the protrusions to provide an interference fit with sidewalls of the channel in which it is received;

a cover member defining a cavity therein, the dielectric housing receive din the cavity;

and an inner surface of the cover member engages said contacts to prevent said contacts from being displaced from said channels.

2. An electrical connector as recited in claim 1, wherein the second protrusion is proximate said mounting end.

3. An electrical connector as recited in claim 1, wherein the first and second protrusions extend from the same major surface of the body section.

4. An electrical connector as recited in claim 1, wherein the first and second protrusions extend from opposite major surfaces of said body section.

5. An electrical connector as recited in claim 1, further comprising latch means on the cover member cooperable with a latch shoulder on the housing to secure the cover member and housing together.

6. An electrical connector as recited in claim 1, wherein each channel further comprises a bottom wall, said bottom wall having a central rib extending outwardly therefrom along a limited length and wherein the body portion of the contact further comprises a minor edge, said minor edge having a notch therein substantially complementary to said rib, whereby the contact is maintained in a predetermined axial position in the channel of the housing by the rib cooperating with the notch.

7. An electrical connector as recited in claim 1, wherein each contact further comprises a third protrusion intermediate said first and second protrusions.

8. An electrical connector as recited in claim 7, wherein the first and second protrusions extend from the same major surface of the contact and the third protrusion extends from the other major surface of the contact.

9. An electrical connector, comprising:

a dielectric housing having a plurality of uniformly spaced channels in opposed major surfaces thereof, each of said channels defined by opposed first and second sidewalls;

a contact received in each channel, each contact having a mating end, a mounting end and a body section extending therebetween;

said body section defining an axis between said mating end and said mounting end, said body section defining opposed first and second major surfaces;

a first protrusion extending from the first major surface proximate said mating end to engage said first sidewall, and a second protrusion extending from one of said major surfaces to engage one of said sidewalls at a location axially spaced from said mating end farther than said first protrusion, whereby each contact is resiliently bent by the protrusions to provide an interference fit with sidewalls of the channel in which it is received;

a cover member defining a cavity therein, the dielectric housing received in the cavity;

the housing further comprises a boardlock receiving post extending therefrom, the boardlock receiving post having a boardlock secured thereon;

and the cover member having a surface engageable with the boardlock to prevent the boardlock from being removed from the boardlock receiving post.

10. An electrical connector, comprising:

a dielectric housing having at least one channel therein, said at least one channel defined by opposed first and second sidewalls;

a contact received in said channel, said contact having a mating end, a mounting end and a body section extending therebetween;

said body section defining opposed first and second major surfaces;

a first protrusion extending from the first major surface proximate said mating end to engage said first sidewall, and a second protrusion extending from one of said major surfaces to engage one of said sidewalls at a location axially spaced from said mating end farther than said first protrusion, whereby the contact is resiliently bent by the protrusions to provide an interference fit with sidewalls of the channel;

and an inner surface of the cover member engages said contact to prevent said contact from being displaced from said channel.

11. An electrical connector as recited in claim 10, wherein the second protrusion is proximate said mounting end.

12. An electrical connector as recited in claim 10, wherein the first and second protrusions extend from the same major surface of the body section.

13. An electrical connector as recited in claim 10, the first and second protrusions extend from opposite major surfaces of said body section.

14. An electrical connector as recited in claim 10, further comprising a cover member defining a cavity therein, the dielectric housing received in the cavity.

15. An electrical connector as recited in claim 14, further comprising latch means on the cover member cooperable with a latch shoulder on the housing to secure the cover member and housing together.

16. An electrical connector as recited in claim 10, wherein the channel further comprises a bottom wall, said bottom wall having a central rib extending outwardly therefrom along a limited length and wherein the body portion of the contact further comprises a minor edge, said minor edge having a notch therein substantially complementary to said rib, whereby the contact is maintained in a predetermined axial position in the housing.

17. An electrical connector as recited in claim 10, further comprising a third protrusion intermediate said first and second protrusions.

18. An electrical connector as recited in claim 17, wherein the first and second protrusions extend from the same major surface and the third protrusion extends from the other major surface.

19. An electrical connector comprising: an insulative housing, a plurality of channels in the housing extending to a face of the housing, sidewalls of each channel, in each channel an electrical contact, a first portion of said contact extending along a first sidewall of said channel and beyond said face of the housing, at least a first protrusion on said contact engaging at least one of the sidewalls of said channel and pushing said contact against said first sidewall of said channel to align the said surface of said contact beyond said face of the housing with respect to said first sidewall of said channel, at least a second protrusion on said contact engaging at least one of the sidewalls of said channel and pushing said contact against a second sidewall of said channel, a second face of said housing, each said channel extending to said second face, a second portion of said contact extending in said channel and beyond said second face, and at least a third protrusion on said contact engaging at least one of the sidewalls of said channel and pushing said portion of said contact against one of said sidewalls of said channel, whereby each of said first and second portions extend flatly against one of said sidewalls.

20. An electrical connector as recited in claim 19, and further comprising: the first sidewalls of said channels being uniformly spaced along said face of said housing, and the surfaces of the contacts extending along said first sidewalls and beyond said face of the housing being uniformly spaced by being against said first sidewalls.

21. An electrical connector as recited in claim 19, and further comprising: the channels being uniformly spaced along said second face of said housing, and said portions of said contacts extending in said channels and beyond said second face being uniformly spaced by being against said sidewalls of said channels.

* * * * *